US008933684B2

(12) United States Patent
Wang et al.

(10) Patent No.: US 8,933,684 B2
(45) Date of Patent: Jan. 13, 2015

(54) VOLTAGE GENERATOR AND BANDGAP REFERENCE CIRCUIT

(75) Inventors: Hui Wang, Wuyang (CN); Yin Liu, HeNan (CN); Jun Xiang, Shanghai (CN); Huaming Chong, Shanghai (CN)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 269 days.

(21) Appl. No.: 13/603,406

(22) Filed: Sep. 4, 2012

(65) Prior Publication Data

US 2013/0328542 A1 Dec. 12, 2013

(30) Foreign Application Priority Data

Jun. 6, 2012 (CN) ..... 2012 1 0184025

(51) Int. Cl.
*G05F 3/16* (2006.01)
*G05F 3/18* (2006.01)

(52) U.S. Cl.
CPC .. *G05F 3/16* (2013.01); *G05F 3/185* (2013.01)
USPC ..... 323/316

(58) Field of Classification Search
CPC ..... G05F 3/16; G05F 3/24; G05F 3/30; G05F 3/225; G05F 3/242; G05F 3/262; G05F 3/265; G05F 3/245
USPC ..... 323/313, 316, 314, 907; 327/541, 543, 327/539
See application file for complete search history.

(56) References Cited

U.S. PATENT DOCUMENTS

| | | | | | |
|---|---|---|---|---|---|
| 6,002,244 | A * | 12/1999 | Wrathall | ..... | 323/315 |
| 6,124,754 | A * | 9/2000 | Afghahi | ..... | 327/538 |
| 6,144,249 | A * | 11/2000 | Tse | ..... | 327/539 |
| 7,382,305 | B1 * | 6/2008 | Murden et al. | ..... | 341/155 |
| 2002/0180512 | A1 * | 12/2002 | Papathanasiou | ..... | 327/530 |

FOREIGN PATENT DOCUMENTS

| | | | |
|---|---|---|---|
| CN | 101105700 | A | 1/2008 |
| CN | 101763137 | A | 6/2010 |
| EP | 0 301 184 | B1 | 1/1993 |
| TW | 200925824 | | 6/2009 |
| WO | 0107977 | A1 | 2/2001 |

* cited by examiner

*Primary Examiner* — Harry Behm
(74) *Attorney, Agent, or Firm* — Winston Hsu; Scott Margo

(57) ABSTRACT

A voltage generator includes a first transistor, a second transistor, an operational amplifier, a capacitor, a third transistor, a fourth transistor and a first resistor. The operational amplifier includes a first terminal coupled to a second terminal of the first transistor, and a second terminal coupled to a second terminal of the second transistor. The capacitor is coupled between an output terminal of the operational amplifier and a ground terminal. The third transistor is coupled to the first transistor and the output terminal of the operational amplifier. The fourth transistor is coupled to the second transistor, the output terminal of the operational amplifier and the ground terminal. The first resistor is utilized for generating a complementary to absolute temperature voltage according to a voltage difference between a gate-source voltage of the third transistor and a gate-source voltage of the fourth transistor.

18 Claims, 4 Drawing Sheets

VOLTAGE GENERATOR AND BANDGAP REFERENCE CIRCUIT

BACKGROUND OF THE INVENTION

1. Field of the Invention

The present invention relates to a voltage generator and bandgap reference circuit, and more particularly, to a voltage generator and bandgap reference circuit with reduced layout area and high-accuracy reference voltage.

2. Description of the Prior Art

A stable reference voltage source or current source immune to temperature variation, e.g. a bandgap reference circuit, is usually applied in an analog circuit to provide a reference voltage or current, for maintaining accurate operations of a power source or other circuits. In short, a bandgap reference current source mixes currents/voltages of a proportional to absolute temperature (PTAT) and a complementary to absolute temperature (CTAT) with a proper ratio, to cancel out the PTAT and CTAT components, and generates a zero temperature correlated (zero-TC) current/voltage.

In detail, please refer to FIG. 1, which is a schematic diagram of a bandgap reference circuit 10 according to the prior art. The bandgap reference circuit 10 includes an operational amplifier (OP) 100, bipolar junction transistors (BJTs) Q1, Q2, and resistors R1, R2, R3. As shown in FIG. 1, since input voltages VX and VY of positive and negative input terminals of the OP 100 are identical in the bandgap reference circuit 10, i.e. VX=VY=VEB1 and VEB1 is a base-to-emitter voltage of BJT Q1, a PTAT current Iptat can be generated via the resistor R3 and a voltage difference between voltages VY and VZ as shown in Eq. 1, where VZ=VEB2 and VEB2 is a base-to-emitter voltage of BJT Q2, and R3 represents the resistance of the resistor R3.

$$Iptat = \frac{VY - VZ}{R3} = \frac{VEB1 - VEB2}{R3} = \frac{V_T lnK}{R3} \quad (1)$$

where K denotes that the BJT Q2 can be taken as K pieces of BJT Q1 connected in parallel. Referring to Eq. 1, since a thermal voltage $V_T$ is PTAT, the PTAT current Iptat carried by the resistor R3 is also PTAT.

Since the base-to-emitter voltage VEB2 of the BJT Q2 contains a CTAT, Vout denotes the output voltage of the bandgap reference circuit 10 as shown in Eq. 2:

$$Vout = \frac{V_T \ln K}{R3} * (R2 + R3) + VEB2 \quad (2)$$

$$\frac{\partial Vout}{\partial T} = \frac{R2 + R3}{R3} * \frac{\partial V_T}{\partial T} * \ln K + \frac{\partial VEB2}{\partial T}$$

Referring to Eq. 2, the term $$\frac{\partial Vout}{\partial T}$$

can be set equal to zero by choosing a suitable value of K and suitable resistances of the resistors R2 and R3, such that the bandgap reference voltage Vout is a zero-TC voltage.

However, the conventional bandgap reference circuit using BJTs for performing temperature compensation usually requires a higher power supply voltage and a higher reference voltage, which leads to large static power loss and is improper for applications requiring lower voltage. Meanwhile, the conventional bandgap reference circuit using BJTs also needs a large layout area. Consequently, manufacturers have provided a bandgap reference circuit using complementary metal oxide semiconductor (CMOS) for temperature compensation; however, a CTAT voltage generated by such circuits varies as manufacturing processes vary, and accuracy of the zero-TC voltage is also reduced. In such a situation, the prior art has to be improved.

SUMMARY OF THE INVENTION

It is therefore an objective of the present invention to provide a voltage generator and a bandgap reference circuit.

The present invention discloses a voltage generator, including a first transistor, a second transistor, an operational amplifier (OP), a capacitor, a third transistor, a fourth transistor, and a resistor. The first transistor comprises a first terminal coupled to a voltage source and a second terminal coupled to a third terminal; the second transistor comprises a first terminal coupled to the voltage source and a second coupled to a third terminal; the OP comprises a first input terminal coupled to the second terminal and the third terminal of the first transistor, a second input terminal coupled to the second terminal and the third terminal of the second transistor, and a output terminal; the capacitor comprises a first terminal coupled to the output terminal of the OP and a second terminal coupled to a ground end; the third transistor comprises a first terminal coupled to the third terminal of the first transistor, a second terminal coupled to the output terminal of the OP and the first terminal of the capacitor, and a third terminal; the fourth transistor comprises a first terminal coupled to the third terminal of the second transistor, a second terminal coupled to the output of the OP and the first terminal of the capacitor, and a third terminal coupled to the ground end; and the resistor is coupled between the third terminal of the third transistor and ground end for generating a complementary to absolute temperature (CTAT) voltage, according to a voltage difference between a gate-source voltage of the third transistor and a gate-source voltage of the fourth transistor.

The present invention further discloses a bandgap reference circuit, including a proportional to absolute temperature (PTAT) current source, a complementary to absolute temperature (CTAT) voltage generator, and a zero temperature correlated (zero-TC) voltage generator. The PTAT current source is for generating a PTAT; the CTAT voltage generator includes a first transistor, a second transistor, an operational amplifier (OP), a capacitor, a third transistor, a fourth transistor, and a first resistor. The first transistor comprises a first terminal coupled a voltage source and a second terminal coupled to a third terminal; the second transistor comprises a first terminal coupled to the voltage source and a second terminal coupled to a third terminal; the OP comprises a first input terminal coupled to the second terminal and third terminal of the first transistor, a second terminal coupled to the second terminal and third terminal of the second transistor, and a output terminal; the capacitor comprises a first terminal coupled to the output terminal of the OP and a second terminal coupled to a ground end; the third transistor comprises a first terminal coupled to the third terminal of the first transistor, a second terminal coupled to the output terminal of the OP and the first terminal of the capacitor, and a third terminal; the fourth transistor comprises a first terminal coupled to the third terminal of the second transistor, a second terminal coupled to the output terminal of the OP and the first terminal of the capacitor, and a third terminal coupled to the ground end; the first resistor is coupled between the third terminal of the third transistor and ground end for generating a CTAT voltage, according to a voltage difference between a gate-source voltage of the third transistor and a gate-source voltage of the fourth transistor; and the zero-TC voltage generator is coupled between the PTAT current source and the CTAT voltage generator for summing a PTAT voltage and a CTAT voltage to generate a zero-TC voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
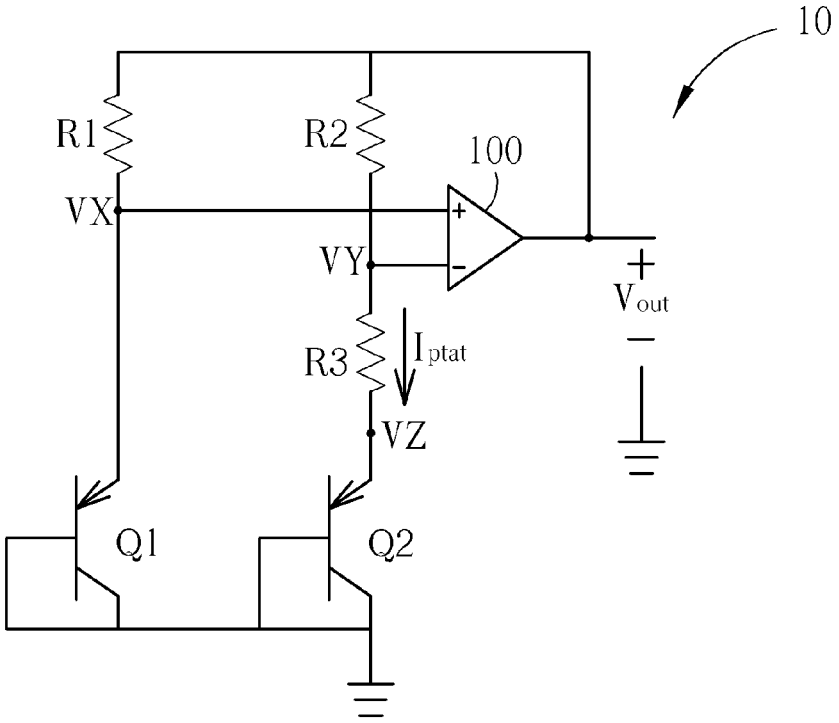
FIG. 1 PRIOR ART
FIG. 1 is a schematic diagram of a bandgap reference circuit according to the prior art.
Figure 2A:
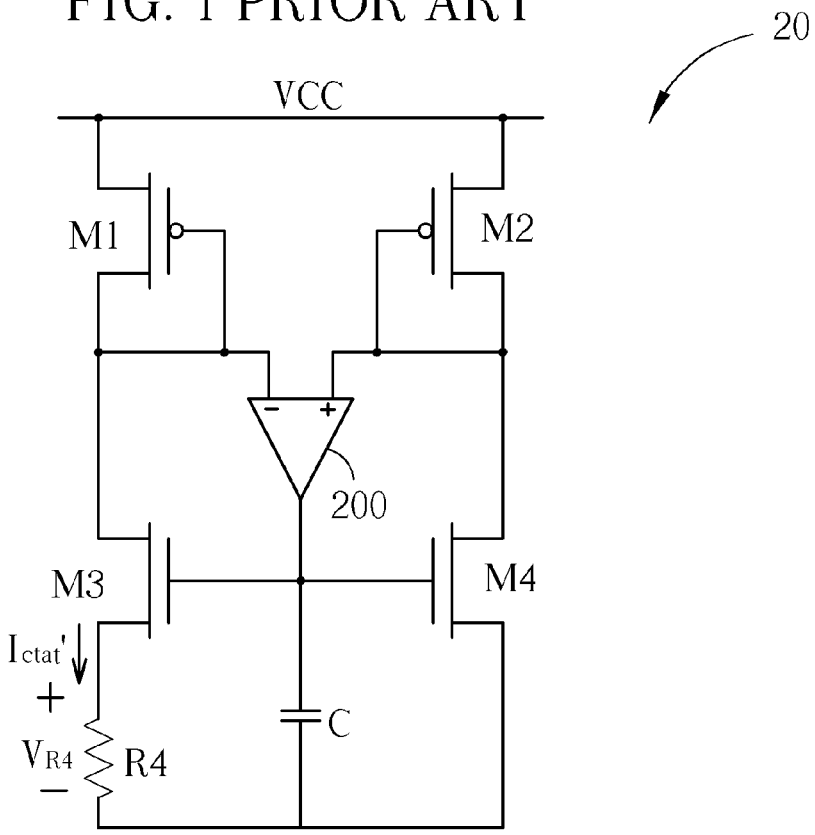
FIG. 2A is a schematic diagram of a complementary to absolute temperature (CTAT) voltage generator according to an embodiment of the present invention.

Please refer to FIG. 2A, which is a schematic diagram of a complementary to absolute temperature (CTAT) voltage generator 20 according to an embodiment of the present invention. The CTAT voltage generator 20 includes transistors M1-M4, an operational amplifier (OP) 200, a capacitor C and a resistor R4. As shown in FIG. 2A, an input terminal of the OP 200 is coupled to the transistor M1 and another input terminal of the OP 200 is coupled to the transistor M2. The OP 200 generates a control signal for controlling operations of the transistors M3 and M4 according to signals received by the input terminals of the OP 200. The capacitor C is coupled between an output terminal of the OP 200 and a ground end. The transistor M3 is coupled to the transistor M1 and the output terminal of the OP 200. The transistor M4 is coupled to the transistor M2, the output terminal of the OP 200 and the ground end. The transistors M3 and M4 can be n-type metal-oxide-semiconductor (NMOS) transistors. The resistor R4 is coupled between the transistor M3 and the ground end, for generating a CTAT voltage according to a voltage difference between gate-source voltages of the transistors M3 and M4. For example, as shown in FIG. 2A, a voltage difference $V_{R4}$ across the resistor R4 equals the voltage difference between the gate-source voltages of the transistors M3 and M4. The voltage difference $V_{R4}$ across the resistor R4 represents a CTAT voltage.

In short, the CTAT voltage generator 20 of the present invention generates the CTAT voltage required by a bandgap reference circuit according to the voltage difference between the gate-source voltages of the transistors M3 and M4. In other words, the CTAT voltage generator 20 generates a high-accuracy CTAT voltage without utilizing BJTs, such that a layout area of the CTAT voltage generator 20 can be reduced dramatically.

In detail, the transistor M1 is coupled to one input terminal of the OP 200, and the transistor M2 is coupled to another input terminal of the OP 200, such that the OP 200 generates a control signal according to input signals of the transistors M1 and M2, to control the transistors M3 and M4 to operate in a sub-threshold region. Preferably, the transistors M3 and M4 are different types of metal-oxide-semiconductor (MOS) transistors, so that a threshold voltage of the transistor M3 is different from a threshold voltage of the transistor M4. In detail, while the transistors M3 and M4 with different threshold voltages operate in the sub-threshold region, a difference between the gate-source voltages of the transistors M3 and M4 is substantially equal to the voltage difference between the threshold voltages of the transistors M3 and M4 according to current-voltage (I-V) characteristics of transistors. Further explanation is presented with Eq. 3 and Eq. 4 in the following. While the transistors M3 and M4 operate in the sub-threshold region and drain-source voltages of the transistors M3 and M4 are both larger than four times a thermal voltage $V_T$, I-V characteristics of the transistors M3 and M4 can be represented by Eq. 3:

$$I_{D_M3} = \mu V_T^2\left(\frac{W}{L}\right)_3 \exp\left(\frac{V_{GS_M3} - V_{th_M3}}{mV_T}\right) \tag{3}$$

$$I_{D_M4} = \mu V_T^2\left(\frac{W}{L}\right)_4 \exp\left(\frac{V_{GS_M4} - V_{th_M4}}{mV_T}\right)$$

where $I_{D_M3}$ and $I_{D_M4}$ are taken as drain-source currents of the transistors M3 and M4, μ is trench carrier mobility, $V_{GS_M3}$ and $V_{GS_M4}$ are gate-source voltages of the transistors M3 and M4, $V_{th_M3}$ and $V_{th_M4}$ are threshold voltages of the transistors M3 and M4, m is a factor of slope in a sub-threshold region, and W/L is a width-length ratio. If $I_{D_M3}=I_{D_M4}$, and $(W/L)_3=(W/L)_4$, Eq. 3 can be simplified as the following Eq. 4:

$$V_{GS_M3}-V_{th_M3}=V_{GS_M4}-V_{th_M4}$$

$$\Rightarrow V_{GS_M4}-V_{GS_M3}=V_{th_M4}-V_{th_M3} \tag{4}$$

In other words, from Eq. 4, if the transistors M3 and M4 operate in a sub-threshold region and the drain-source voltages of the transistors M3 and M4 are both larger than four times the thermal voltage $V_T$, a voltage difference between the gate-source voltages of the transistors M3 and M4 is equal to a voltage difference between the threshold voltages of the transistors M3 and M4.

Moreover, as shown in FIG. 2A, the voltage difference $V_{R4}$ across the resistor R4 is the voltage difference between the gate-source voltages of the transistors M3 and M4. Further considering Eq. 4, it can be known that the voltage difference $V_{R4}$ across the resistor R4 is equal to the voltage difference between the threshold voltages of the transistors M3 and M4. The threshold voltages of the transistors M3 and M4 are CTAT voltages, so that the voltage difference $V_{R4}$ across the resistor R4 is also a CTAT voltage, and a current flowing through the resistor R4 is a CTAT current Ictat'. In brief, in the same environment, different types of transistors have different threshold voltages and temperature coefficients, and the present invention utilizes different types of transistors to realize the transistors M3 and M4, such that a CTAT voltage with slight variation in response to variation of manufacturing processes is generated. Therefore, the CTAT voltage generator 20 of the present invention can generate a high-accuracy CTAT voltage according to the voltage difference between the threshold voltages of the transistors M3 and M4 operating in the sub-threshold region.

Figure 2B:
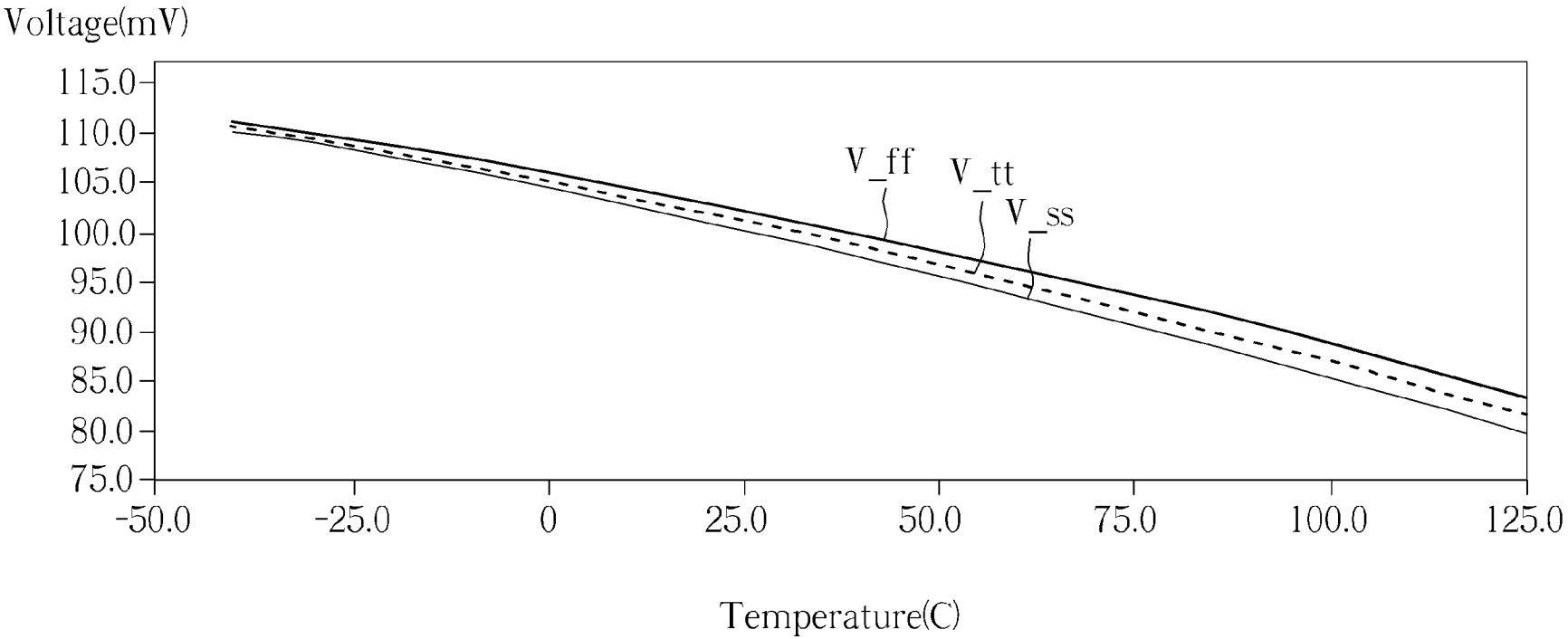
FIG. 2B is a schematic diagram of CTAT voltages when the CTAT voltage generator shown in FIG. 2A operates in different temperatures and processes according to an embodiment of the present invention.

Please refer to FIG. 2B, which is a schematic diagram of CTAT voltages when the CTAT voltage generator 20 shown in FIG. 2A operates in different temperatures and manufacturing processes according to an embodiment of the present invention. In FIG. 2B, TT, FF and SS represent different process environments which are well known by those skilled in the art, and thus further description is omitted herein for brevity. As shown in FIG. 2B, the CTAT voltages are generated by the CTAT voltage generator 20 according to the difference between the threshold voltages of the transistor M3 and M4 operating in the sub-threshold region. As a result, the CTAT voltage generator 20 reaches high accuracy requirements, and more importantly, meets the space limitation in circuitry.

Note that, a spirit of the present invention is to utilize the voltage difference between the threshold voltages of the transistors M3 and M4 to generate the CTAT voltage, so as to meet the high accuracy requirement. The transistors M3 and M4 are different types of NMOS transistors. For example, the threshold voltage of the transistor M4 (e.g. 442 mV) is higher than that of the transistor M3 (e.g. 340 mV), and the transistors M3 and M4 have different temperature coefficients. Besides, the transistors M1 and M2 can be PMOS transistors, and the OP 200 can be realized by any combination of transistors. For example, the OP 200 can include PMOS and NMOS transistors. As mentioned above, the circuit structure of the CTAT voltage generator in the present invention includes MOS transistors and resistors, and the transistors M3 and M4 operate in a sub-threshold region, so that power supply voltage VCC required by the CTAT voltage generator is lower (e.g. 1V), which can reduce power consumption effectively.

Figure 3A:
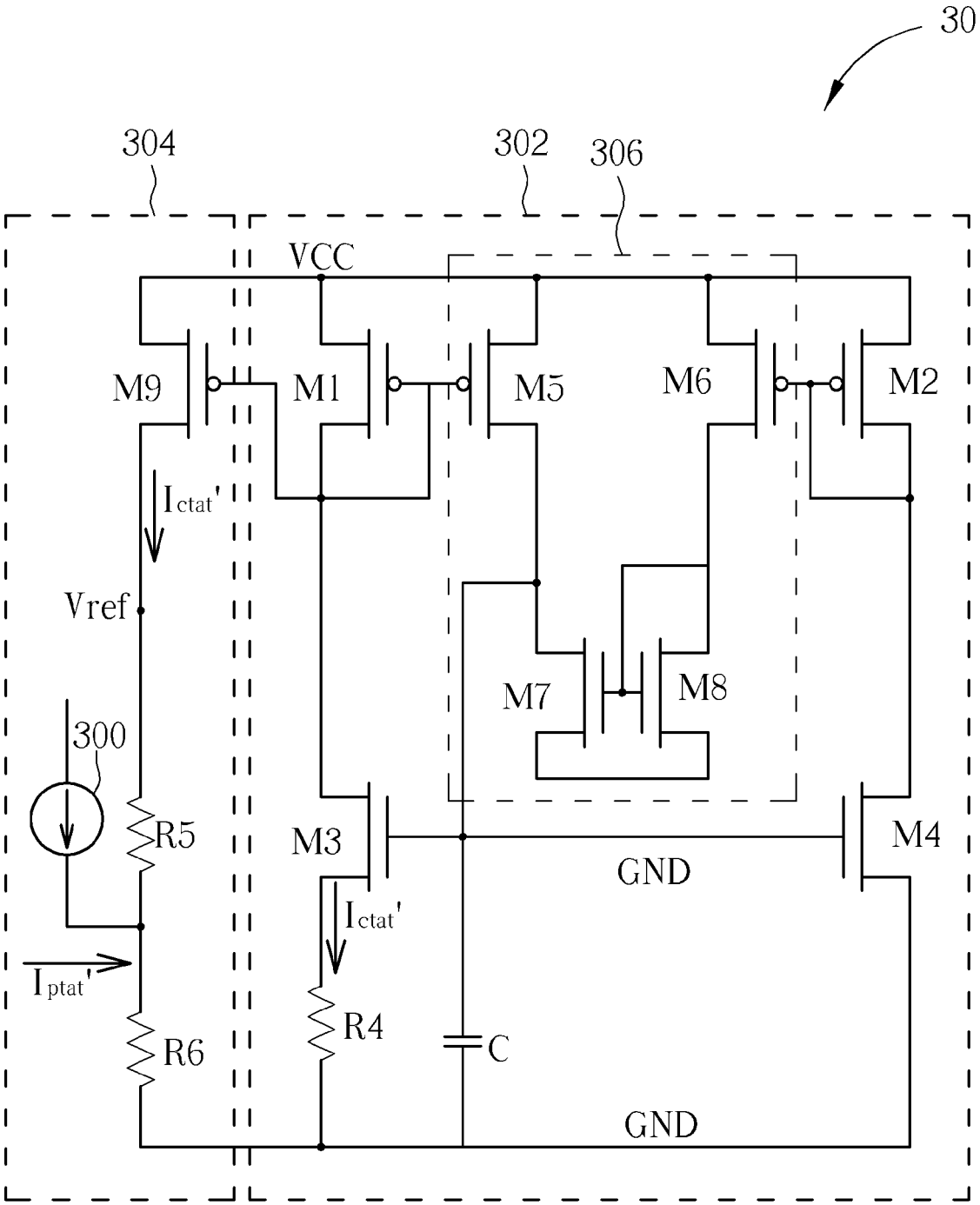
FIG. 3A is a schematic diagram of a bandgap reference circuit according to an embodiment of the present invention.

On the other hand, the CTAT voltage generator 20 is suitable for a zero-TC voltage generation circuit. For example, please refer to FIG. 3A, which is a schematic diagram of a bandgap reference circuit 30 according to an embodiment of the present invention. The bandgap reference circuit 30 includes a PTAT current source 300, a CTAT voltage generator 302, and a zero-TC voltage generator 304. The PTAT current source 300 generates a PTAT current Iptat'. The CTAT voltage generator 302 generates a CTAT voltage and generates a CTAT current Ictat' according to the CTAT voltage. As to the method for generating the CTAT voltage, the CTAT voltage generator 302 and the CTAT voltage generator 20 have similar operation, and further description thereof is omitted for brevity. Besides, the structure of the CTAT voltage generator 302 is similar to that of the CTAT voltage generator 20, and thus the elements in the CTAT voltage generator 302 use the same symbols as those in the CTAT voltage generator 20. Different from the CTAT voltage generator 20, the CTAT voltage generator 302 utilizes an OP 306 instead of the OP 200 shown in FIG. 2A. The OP 306 is merely an exemplary structure diagram of the OP 200, but this is not a limitation of the present invention. The zero-TC voltage generator 304 is coupled between the PTAT current source 304 and the CTAT voltage generator 302 for generating a zero-TC reference voltage $V_{ref}$, according to the PTAT current Iptat' and the CTAT voltage. In such a condition, the bandgap reference circuit 30 can generate a zero-TC voltage with high accuracy according to the PTAT current Iptat' generated by the PTAT current source 304 and the CTAT current Ictat' generated by the CTAT voltage generator 302. Compared with the conventional bandgap reference circuit utilizing BJTs for performing temperature compensation, the present invention can effectively reduce the layout area and reduce the power supply voltage VCC as well, achieving low power consumption. Note that, the bandgap reference circuit 30 shown in FIG. 3A is merely an exemplary embodiment of the present invention, and those skilled in the art can make modification or alterations according to the spirit of the present invention.

Further, the operating principle of the bandgap reference circuit 30 is shown below with current and voltage analysis. The zero-TC voltage generator 304 includes a current mirror M9 and resistors R5, R6. As shown in FIG. 3A, a voltage difference across the resistor R4 of the CTAT voltage generator 302 is a CTAT voltage and the current flowing through the resistor R4 is the CTAT current. The current mirror M9 is utilized for duplicating the CTAT current generated by the CTAT voltage generator 302. The resistor R5 is coupled to the current mirror M9, and the resistor R6 is coupled to the resistor R5, the PTAT current source 300 and the ground end generating the PTAT voltage. Thus, while the zero-TC voltage generator 304 receives the CTAT current Ictat' duplicated by the current mirror M9 and the PTAT current Iptat' generated by the PTAT current source 300, the zero-TC voltage generator 304 can generate a zero-TC voltage Vref according to the PTAT voltage generated by the PTAT current Iptat' and the CTAT voltage generated by the CTAT current Ictat', as shown in Eq. 5:

$$Vref = Iptat' * R6 + Ictat' * (R5 + R6) \tag{5}$$

$$\begin{aligned}\frac{\partial Vref}{\partial T} &= \frac{\partial Iptat'}{\partial T} * R6 + \frac{\partial Ictat'}{\partial T} * (R5 + R6)\\ &= K_P * R6 + K_N * (R5 + R6)\\ &= 0\end{aligned}$$

$$\Rightarrow \frac{K_P}{K_N} = -\frac{(R5 + R6)}{R6}$$

where $K_P$ is a PTAT of the PTAT current Iptat', $K_N$ is a CTAT of the CTAT current Ictat'. Therefore, the zero-TC voltage Vref can be acquired by properly adjusting resistances of the resistors R5 and R6 to satisfy Eq. 5. As a result, the structure of the present invention can generate a high-accuracy zero-TC voltage without using BJTs so that the layout area and the power consumption can be effectively reduced. Besides, the present invention is immune to temperature influences and can obtain high-accuracy voltage output by transistors of different types operating in a sub-threshold region.

Figure 3B:
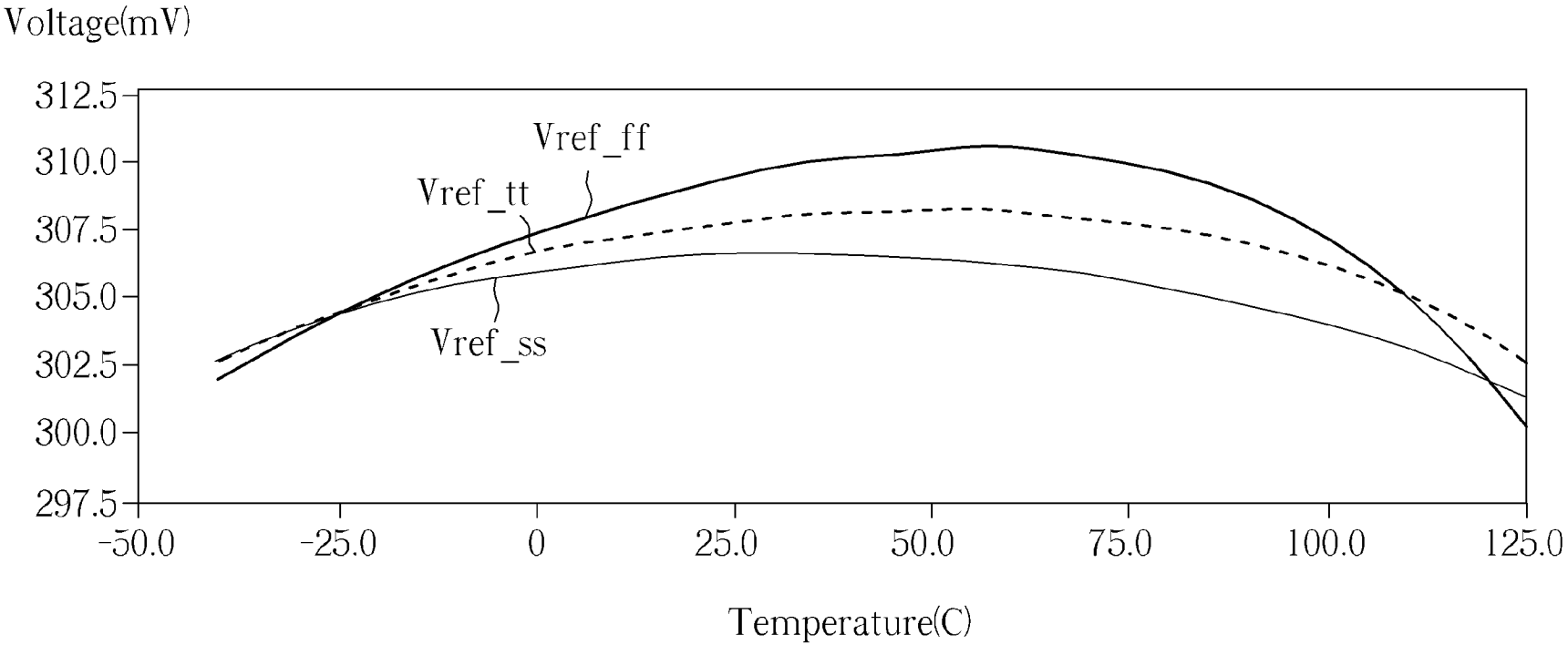
FIG. 3B is a schematic diagram of zero temperature correlated (zero-TC) voltages when the bandgap reference circuit shown in FIG. 3A operates in different temperatures and processes according to an embodiment of the present invention.

Please refer to FIG. 3B, which is a schematic diagram of the zero-TC voltages Vref when the bandgap reference circuit 30 shown in FIG. 3A operates in different temperatures and manufacturing processes according to an embodiment of the present invention. In FIG. 3B, TT, FF, and SS are different process environments which are well known by those skilled in the art, and thus further description is omitted herein for brevity. As shown in FIG. 3B, while temperature rises from −40 degree to 125 degree, the zero-TC voltage in the same process (e.g. the zero-TC voltage curve Vref_tt as shown in FIG. 3B) slightly varies, and a plurality of zero-TC voltages in different process environments (e.g. the zero-TC voltage curves Vref_ff, Vref_tt and Vref_ff as shown in FIG. 3B) slightly vary as well. In other words, the zero-TC voltage slightly varies with temperature and manufacturing process. As a result, the bandgap reference circuit 30 can stabilize the zero-TC voltage Vref when temperature and process vary, and generate the high-accuracy zero-TC voltage.

Note that, FIG. 3A is an exemplary embodiment of the present invention, and can be properly modified. For example, the current mirror M9 is, but not limited to, a PMOS transistor for duplicating the CTAT current. The PTAT current source 300 can also be realized by other elements for generating the PTAT current. Besides, the resistances of the resistors R4, R5, R6 can be adjusted to satisfy the conditions in Eq. 5 according to different embodiments of the present invention, to obtain the required zero-TC voltage.

To sum up, the CTAT voltage generator using BJTs in the prior art requires a high power supply voltage and generates a high reference voltage so that the CTAT voltage generator is not suitable for applications requiring lower supplied voltages and requires large power and layout area. By comparison, the CTAT voltage generator of the present invention does not use BJTs, but uses the threshold voltage difference of different-type MOS transistors operating in a sub-threshold region, to generate a high-accuracy CTAT voltage, so that the layout area and power consumption are effectively reduced. Moreover, the present invention is immune to temperature influences and achieves high accuracy voltage output.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A voltage generator, comprising:

a first transistor, comprising a first terminal coupled to a voltage source, and a second terminal electrically connected to a third terminal;

a second transistor, comprising a first terminal coupled to the voltage source, and a second terminal electrically connected to a third terminal;

an operational amplifier, comprising a first input terminal coupled to the second terminal and the third terminal of the first transistor, a second input terminal coupled to the second terminal and the third terminal of the second transistor, and an output terminal;

a capacitor, comprising a first terminal coupled to the output terminal of the operational amplifier, and a second terminal coupled to a ground end;

a third transistor, comprising a first terminal coupled to the third terminal of the first transistor, and a second terminal coupled to the output terminal of the operational amplifier and the first terminal of the capacitor, and a third terminal;

a fourth transistor, comprising a first terminal coupled to the third terminal of the second transistor, a second terminal coupled to the output terminal of the operational amplifier and the first terminal of the capacitor, and a third terminal coupled to the ground end; and a first resistor coupled between the third terminal of the third transistor and the ground end.

2. The voltage generator of claim 1, wherein the first transistor and the second transistor are P-type metal-oxide-semiconductor (PMOS) transistors.

3. The voltage generator of claim 1, wherein the operational amplifier is an operational amplifier with PMOS transistors and n-type metal-oxide-semiconductor (NMOS) transistors.

4. The voltage generator of claim 1, wherein the operational amplifier generates a control signal according to signals received by the first input terminal and the second input terminal so that the third transistor operates in a first sub-threshold region and the fourth transistor operates in a second sub-threshold region accordingly.

5. The voltage generator of claim 1, wherein the third transistor and the fourth transistor are NMOS transistors.

6. The voltage generator of claim 1, wherein the third transistor and the fourth transistor are different types of transistors, a threshold voltage of the third transistor is different from a threshold voltage of the fourth transistor, and a voltage difference across the first resistor is equal to a voltage difference between the threshold voltage of the third transistor and the threshold voltage of the fourth transistor.

7. The voltage generator of claim 1, wherein the voltage difference across the first resistor equals a voltage difference between a gate-source voltage of the third transistor and a gate-source voltage of the fourth transistor.

8. The voltage generator of claim 1, wherein the first resistor generates a complementary to absolute temperature (CTAT) voltage according to a voltage difference between a gate-source voltage of the third transistor and a gate-source voltage of the fourth transistor and generates a CTAT current according to the CTAT voltage.

9. A bandgap reference circuit, comprising:

a proportional to absolute temperature (PTAT) current source, for generating a PTAT current;

a CTAT voltage generator, comprising:

a first transistor, comprising a first terminal coupled to a voltage source, and a second terminal electrically connected to a third terminal;

a second transistor, comprising a first terminal coupled to the voltage source, and a second terminal electrically connected to a third terminal;

an operational amplifier, comprising a first input terminal coupled to the second terminal and the third terminal of the first transistor, a second input terminal coupled to the second terminal and the third terminal of the second transistor, and an output terminal;

a capacitor, comprising a first terminal coupled to the output terminal of the operational amplifier, and a second terminal coupled to a ground end;

a third transistor, comprising a first terminal coupled to the third terminal of the first transistor, a second terminal coupled to the output terminal of the operational amplifier and the first terminal of the capacitor, and a third terminal;

a fourth transistor, comprising a first terminal coupled to the third terminal of the second transistor, a second terminal coupled to the output terminal of the operational amplifier and the first terminal of the capacitor, and a third terminal coupled to the ground end; and a first resistor, coupled between the third terminal of the third transistor and the ground end, for generating a CTAT voltage according to a voltage difference between a gate-source voltage of the third transistor and a gate-source voltage of the fourth transistor; and a zero temperature coefficient voltage generator, coupled to the PTAT current source and the CTAT voltage generator, for generating a zero temperature coefficient voltage according to the PTAT current and the CTAT voltage.

10. The bandgap reference circuit of claim 9, wherein the first transistor and the second transistor are p-type metal-oxide-semiconductor (PMOS) transistors.

11. The bandgap reference circuit of claim 9, wherein the operational amplifier is an operational amplifier with PMOS transistors and n-type metal-oxide-semiconductor (NMOS) transistors.

12. The bandgap reference circuit of claim 9, wherein the operational amplifier generates a control signal according to signals received by the first input terminal and the second input terminal so that the third transistor operates in a first sub-threshold region and the fourth transistor operates in a second sub-threshold region accordingly.

13. The bandgap reference circuit of claim 9, wherein the third transistor and the fourth transistor are NMOS transistors.

14. The bandgap reference circuit of claim 9, wherein the third transistor and the fourth transistor are different types of transistors, a threshold voltage of the third transistor is different from a threshold voltage of the fourth transistor, and a voltage difference across the first resistor is equal to a voltage difference between a threshold voltage of the third transistor and a threshold voltage of the fourth transistor.

15. The bandgap reference circuit of claim 9, wherein a voltage difference across the first resistor is equal to a voltage difference between a gate-source voltage of the third transistor and a gate-source voltage of the fourth transistor.

16. The bandgap reference circuit of the claim 9, wherein the first resistor further generates a CTAT current according to the CTAT voltage.

17. The bandgap reference circuit of claim 9, wherein the zero temperature coefficient voltage generator comprises:

a current mirror, for duplicating the CTAT current;

a second resistor, comprising a first terminal coupled to the current mirror; and a third resistor, comprising a first terminal coupled to a second terminal of the second resistor and the PTAT current source, and a second terminal coupled to the ground end;

wherein the PTAT current flows through the third resistor, the CTAT current flows through the second resistor and the third resistor, and the zero temperature coefficient voltage is a sum of a voltage difference across the second resistor and a voltage difference across the third resistor.

18. The bandgap reference circuit of claim 9, wherein the current mirror is a PMOS transistor.

* * * * *